US006129291A

United States Patent [19]

Commeville

[11] Patent Number: 6,129,291

[45] Date of Patent: Oct. 10, 2000

[54] ADVERTISING DEVICE FOR USE WITH A DRINKING FOUNTAIN

[76] Inventor: Marc Jeffrey Commeville, 811 Pebble Brook Pl., Noblesville, Ind. 46060

[21] Appl. No.: 09/370,956

[22] Filed: Aug. 10, 1999

[51] Int. Cl.[7] ..... B05B 17/08; E03B 9/20

[52] U.S. Cl. ..... 239/24; 239/16; 239/17; 239/18; 239/28; 239/29; 40/299.01; 40/630

[58] Field of Search ..... 239/16, 17, 18, 239/24, 28, 29; 362/812; 40/299.01, 541, 630; D07/304; D23/201

[56] References Cited

U.S. PATENT DOCUMENTS

| | | | |
|---|---|---|---|
| D. 92,157 | 5/1934 | Adams | D07/304 X |
| 1,349,775 | 8/1920 | Lyman et al. | 239/29 |
| 1,357,436 | 11/1920 | Armstrong | 239/29 |
| 2,877,051 | 3/1959 | Cushman et al. | 239/17 |
| 3,635,402 | 1/1972 | Kawamura et al. | 239/18 |
| 3,693,926 | 9/1972 | Carter | 248/460 |
| 3,799,439 | 3/1974 | Wright | 239/29 |
| 4,295,609 | 10/1981 | Brown, Jr. | 239/29 |
| 4,368,231 | 1/1983 | Egert et al. | 428/220 |
| 4,443,961 | 4/1984 | Gilroy | 40/308 |
| 4,837,956 | 6/1989 | Dolence | 40/299 |
| 4,922,639 | 5/1990 | Rehrig | 40/308 |
| 5,051,310 | 9/1991 | Horn et al. | 428/423.3 |
| 5,613,696 | 3/1997 | de Luna | 280/33.992 |

*Primary Examiner*—Andres Kashnikow
*Assistant Examiner*—Robin O. Evans
*Attorney, Agent, or Firm*—Kyle S. Brant

[57] ABSTRACT

A device for displaying advertising in association with a drinking fountain or water fountain is disclosed. A first embodiment of the invention comprises forming a clear plastic panel or laminate to conform with the splash guard and basin portions of a drinking fountain. The plastic panel or laminate includes advertising information attached to the plastic or disposed between lamination layers of the plastic. Alternatively, a slot for receiving advertising may be formed in the plastic so that the advertising may be periodically replaced. The formed plastic is then situated over the existing combination splash guard/basin of a corresponding water fountain. Advertising is viewable in the vertical splash guard area as well as the basin area. In a second embodiment, a plastic member is molded or formed in the shape of a water fountain splash guard/basin and the plastic member replaces the original stainless steel splash guard/basin of the water fountain. Advertising information is attached to the member and displayable through transparent portions of the plastic member. Additional features include back-lighting disposed within or behind the replacement splash guard/basin provide enhance advertising effectiveness with eye-catching characteristics.

19 Claims, 5 Drawing Sheets

ADVERTISING DEVICE FOR USE WITH A DRINKING FOUNTAIN

FIELD OF THE INVENTION

This invention relates in general to devices useful in displaying advertising matter and more particularly to such devices adapted for use with drinking fountains.

BACKGROUND OF THE INVENTION

It is desirable, particularly in airports, bus stations, and other public venues such as shopping malls, to bring to the attention of the public product or service information that pertains to the particular locale. For example, airline or airport restaurant advertising matter would be beneficially displayed at an airport. Likewise, retail shopping advertisements would be desired in a shopping mall. Advertising space is normally at a premium in airports, bus terminals, shopping malls and the like. Judicious use of available yet unused advertising space benefits the advertiser in conveying a marketing message to the consuming public as well as the consumer who is apprised of perhaps unknown products and services available nearby.

What is needed is a device that enhances the available advertising space in airports, shopping malls, bus terminals, train stations and the like.

SUMMARY OF THE INVENTION

An advertising device for use with a drinking fountain having a combination splash guard/basin with a drain aperture in the splash guard/basin, and a water dispensing spout attached to the splash guard/basin, according to one aspect of the present invention, comprises a thin plastic member shaped to conform with the splash guard/basin of the drinking fountain, the thin plastic member including a water dispensing aperture for receiving the water dispensing spout therethrough and a drain aperture situated to coincide with the drain aperture of the drinking fountain, and wherein the thin plastic member is disposed immediately adjacent and overlaying the splash guard/basin of the drinking fountain, and advertising material attached to the thin plastic member and disposed behind the exposed surface of the thin plastic member.

A drinking fountain, according to another aspect of the present invention, comprises a housing, bubbler means for producing a flow of water, said bubbler means attached to a source of pressurized water, a clear plastic splash guard/basin attached to said housing, said splash guard/basin including a substantially vertical splash guard portion and a substantially horizontal liquid collection basin portion having a depression therein, a bubbler aperture, and a drain aperture disposed in said basin portion, and wherein said bubbler is disposed in said bubbler aperture and attached to said plastic splash guard/basin, a drain pipe attached over said drain aperture of said plastic splash guard/basin, and advertising material attached to said plastic splash guard/basin, said advertising material disposed between said housing and said plastic splash guard/basin.

One object of the present invention is to provide an advertising space heretofore unused.

Another object of the present invention is to bring to the attention of those that use a drinking fountain in a public place products and services of nearby businesses.

Still another object of the present invention is to provide a convenient mechanism for display of advertising matter that is readily revised or updated as needed.

Yet another object of the present invention is to provide a cost effective advertising solution that does not detract from the general surroundings.

These and other objects of the present invention will become more apparent from the following description of the preferred embodiments.

DESCRIPTION OF THE PREFERRED EMBODIMENTS

Figure 2:
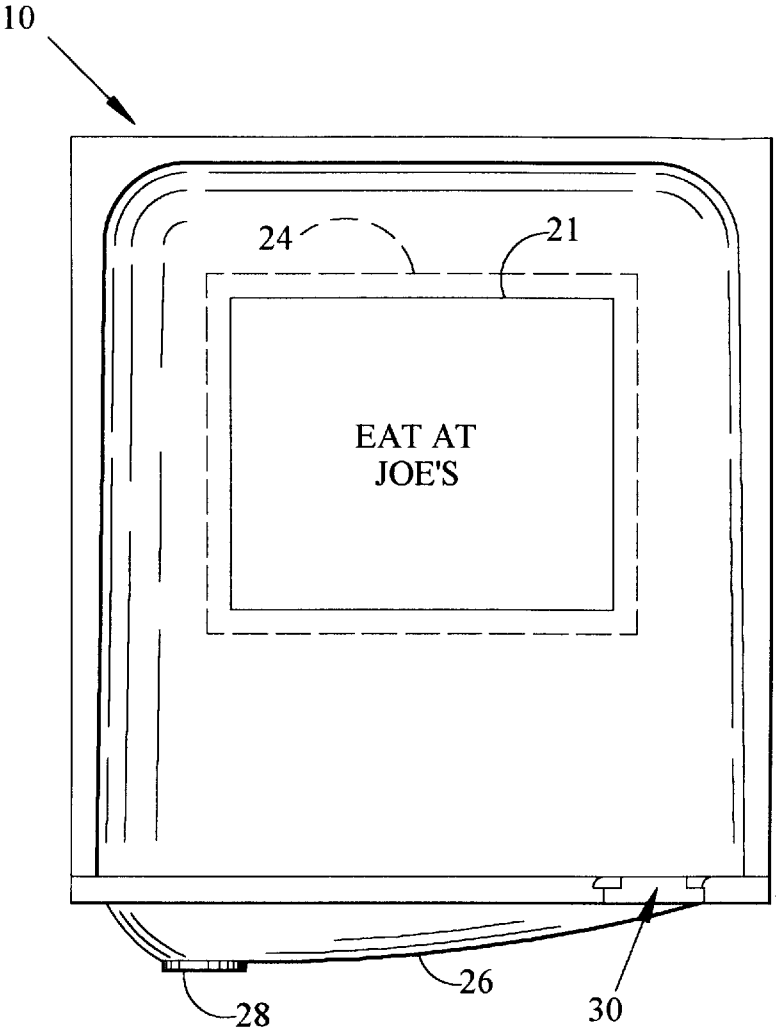
FIG. 2 is front elevational view of the advertising device shown in FIG. 1 removed from the drinking fountain.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
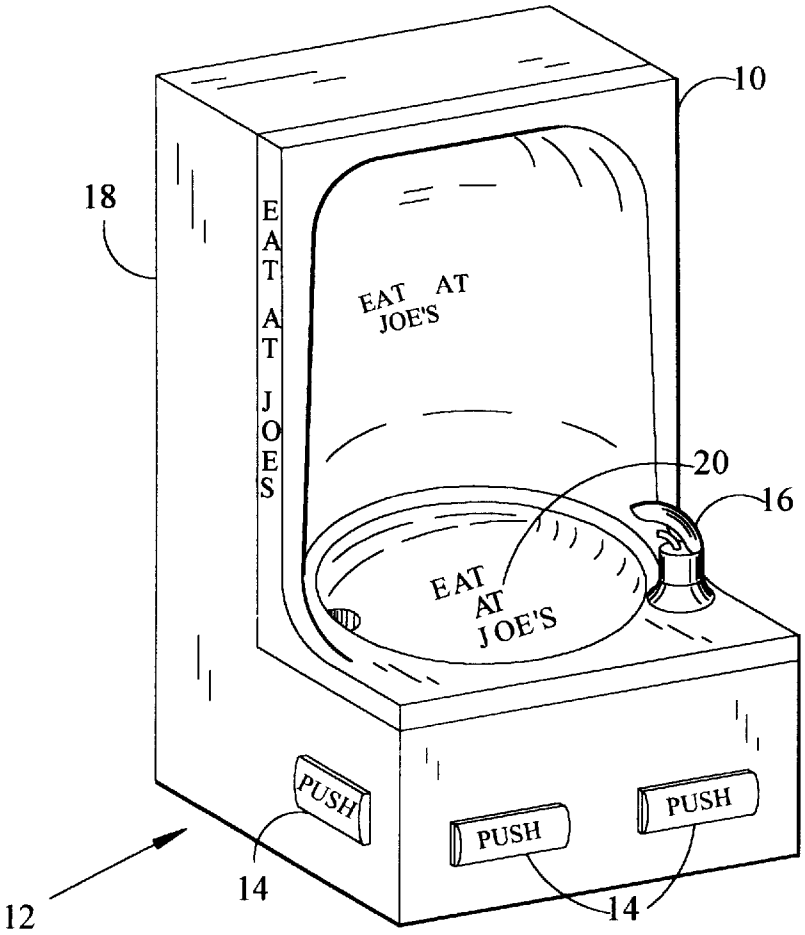
FIG. 1 is a perspective view of a drinking fountain of the prior art with an advertising device according to the present invention installed thereon.

Referring now to FIG. 1, an advertising device 10 according to one aspect of the present invention is shown attached to a drinking fountain 12. Drinking fountain 12 includes water valve actuator push pads 14 which, when depressed, activate an internal water valve (not shown) causing water to flow through an aperture in water bubbler 16. Within housing 18 are typically found pipes and plumbing fittings that deliver a fresh supply of drinking water to the fountain 12 as well as drain pipes for disposal of excess water that collects in basin 20. In addition, optional refrigeration units (not shown) are disposed within housing 18 to cool the supply of fresh water.

Figure 3:
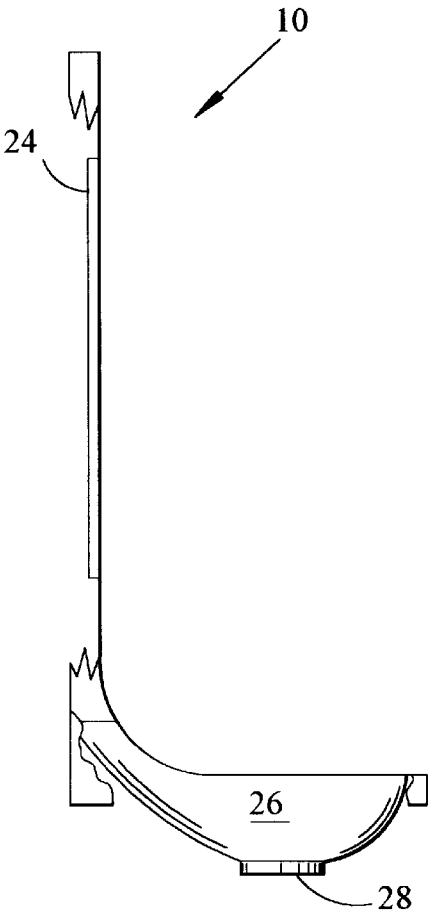
FIG. 3 is a side view of the advertising device shown in FIG. 2 according to the present invention.

Referring now to FIGS. 2 and 3, device 10 is shown in more particular detail. Device 10 is a thin-walled member preferably made from plastic and formed to conform to the combination splash guard/basin typical of wall installation drinking fountains known in the art. Such basins are typically constructed of stainless steel or the like and need no further discussion as such are well known in the prior art. In practice, device 10 may be as thin as 0.020 inches. Advertising matter 21 is attached to device 10 and disposed between device 10 and fountain 12. Alternatively, advertising matter 21 is molded or laminated into device 10 for display to the casual user of fountain 12. It is desirable that advertising matter 21 appear on all surfaces of device 10 so that advertising messages are visible from many viewpoint positions relative to fountain 12. Where device 10 is a constructed of plastic laminates, advertising matter 21 is most conveniently displayed beneath a clear laminate. Plastic laminates are used to "sandwich" advertising matter 21 between clear plastic layers to protect the advertising matter from water and the environment, yet make advertising matter 21 readily viewable by the public. Alternatively, it is contemplated that a plastic pocket 24 (indicated by broken lines in FIG. 2 and shown in FIG. 3) is molded into or attached to the vertical portion of device 10 so that advertising material 21 is disposed therein between device 10 and the splash guard of fountain 12. The use of a pocket or slot 24 enables one to readily remove and replace the advertising material 21 contained in slot 24 without removing device 10 from the fountain 12. Device 10 has a basin portion 26 that includes an aperture 28 therein. Aperture 28 conforms to and aligns with the drain aperture of fountain 12 wherein excess water drains therethrough. Aperture 30 enables device 10 to be vertically lowered onto the top surface of fountain 12 so that bubbler 16 is received through aperture 30.

Figure 4:
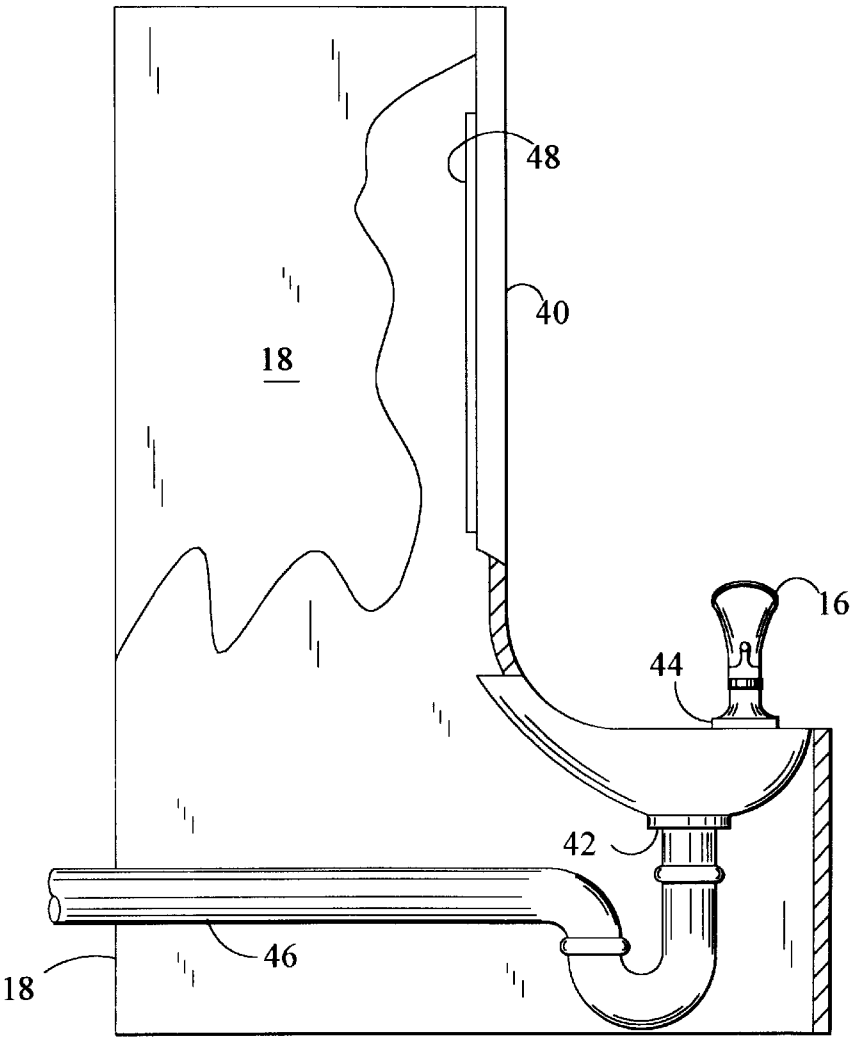
FIG. 4 is a side cutaway view of a drinking fountain with another embodiment of the advertising device according to the present invention installed thereon.
Figure 5:
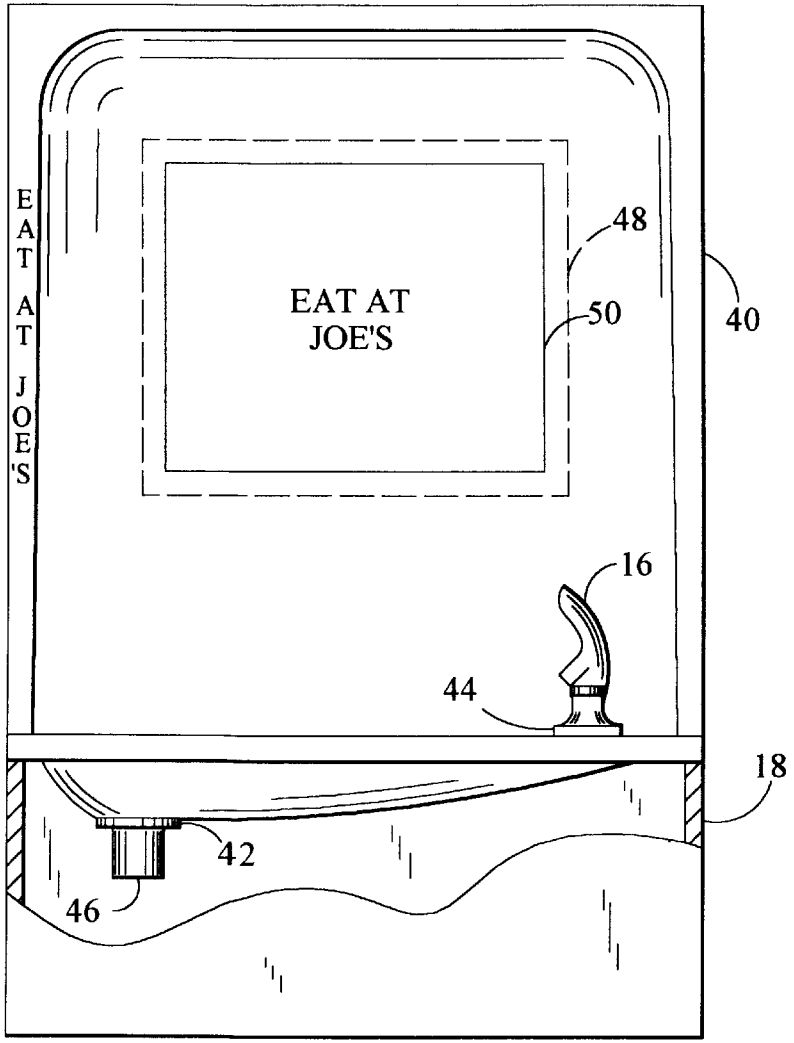
FIG. 5 is a front elevational view of the drinking fountain of FIG. 4 with an advertising device according to the present invention attached thereto.

Referring now to FIGS. 4, and 5, another embodiment of an advertising device 40 according to another aspect of the present invention is shown attached to a drinking fountain 12. FIG. 4 is a partial cutaway view of device 40 shown attached to a drinking fountain and FIG. 5 is a partial front elevational view thereof. Device 40 is a substitute or replacement for the original splash guard and basin of a drinking fountain and attaches directly to the fountain housing 18. In practice, the original stainless steel splash guard/basin of the fountain 12 is removed, and device 40 is installed as a replacement therefor. Device 40 includes apertures at 42 and 44. Aperture 42 enables attachment of the drain pipe 46 to device 40. Aperture 44 provides a mounting aperture for bubbler 16 so that bubbler 16 may be attached to a source of pressurized water within fountain 12.

Device 40 is constructed using plastic molding techniques well known in the plastics art. Device 40 is a thick-walled plastic molding designed to provide structural support sufficient to replace the original splash guard/basin of fountain 12. Slot or pocket 48 is attached to or integrally molded into device 40 for receiving advertising matter or material 50. Slot 50 is similar in function and purpose to slot 24 of device 10 Slot 48 is attached to device 40 using adhesives or the like where slot 48 is formed separately and subsequently attached to device 40. Preferably, in order for advertising matter 50 to be readily visible to the observer, the plastic used in the construction of device 40 is transparent, at least in the area of the advertising material 50.

Figure 6:
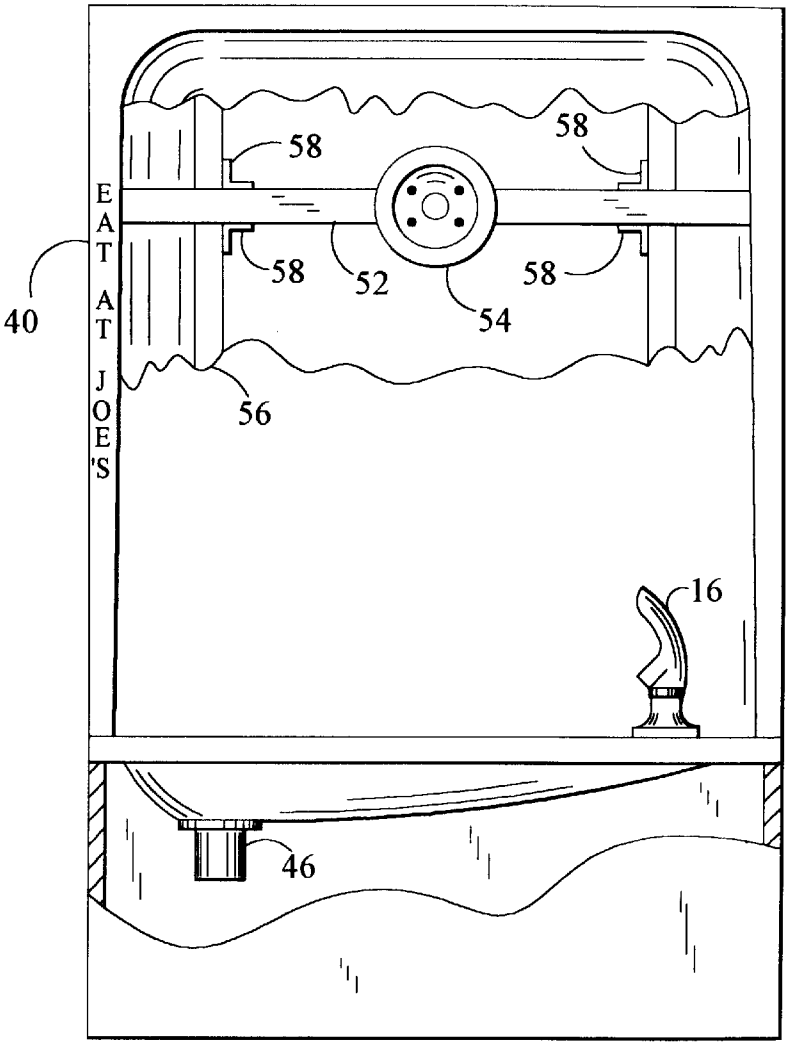
FIG. 6 is a front elevational view of another embodiment of an advertising device according to the present invention including backlighting.
Figure 8:
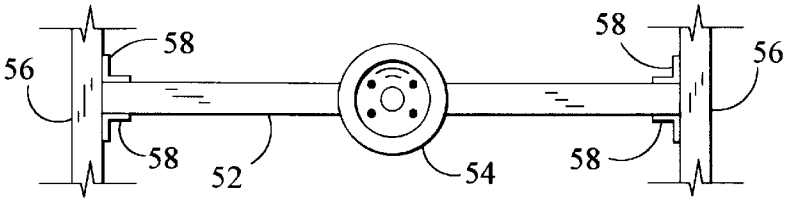
FIG. 8 is a partial view of the backlighting device shown in FIGS. 6 and 7.
Figure 7:
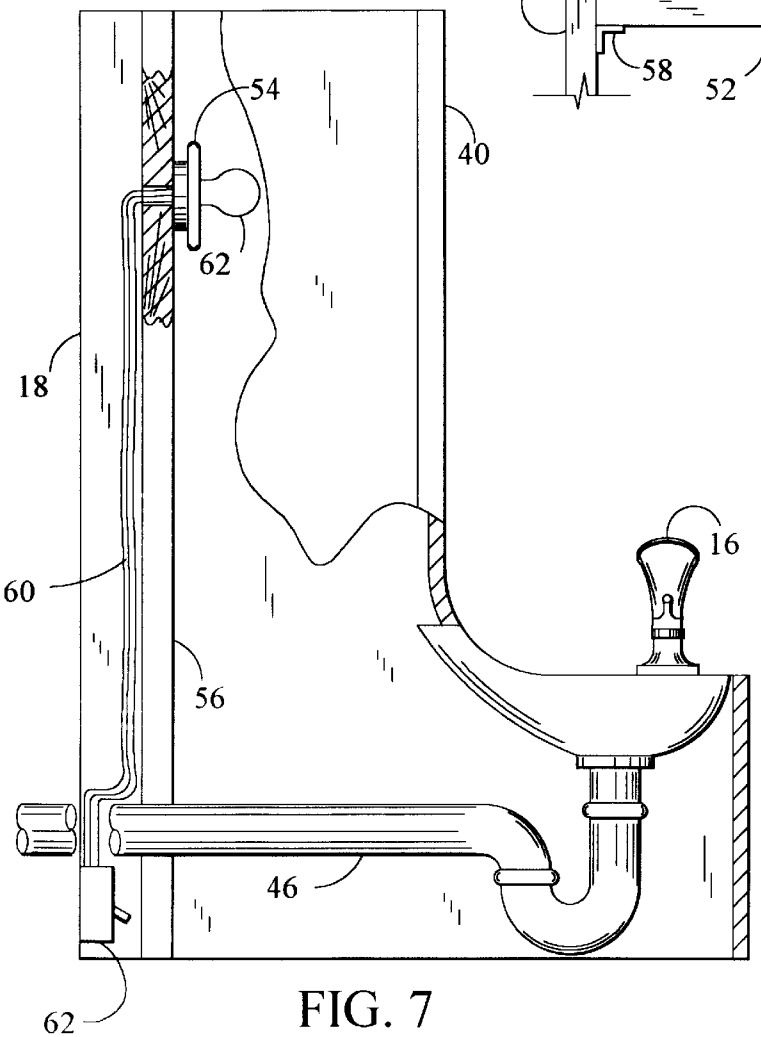
FIG. 7 is a side elevational cutaway view of the drinking fountain of FIG. 6 detailing the location and mounting apparatus for a backlighting device.

Referring now to FIGS. 6, 7 and 8, the embodiment of FIGS. 4 and 5 is shown with additional features. In particular, a bracket 52 with a light fixture 54 mounted thereon is attached to vertical support members 56. Vertical support members 56 are disposed within housing 18 and provide a convenient mechanical structure to which the lighting bracket 52 is mounted. Vertical support members may be wooden or metallic in construction. Angle brackets 58 are attached to vertical support members 56 and to bracket 52 and secure bracket 52 in place to support members 56. Electrical wiring 60 is connected between switch 62 and light fixture 54. Switch 62 controls power supplied to light fixture 54. Light bulb 62 provides a source of light behind the advertising material 50 and enhances the visibility thereof, as well as attracting the eye of the public thereto. Since many in-wall drinking fountains known in the art include a refrigeration unit that requires electrical power, it is contemplated that a source of electrical power is available within housing 18 for connection to switch 62. Also shown in FIGS. 6, 7 and 8 are bubbler 16 and drain pipe 46.

Figure 9:
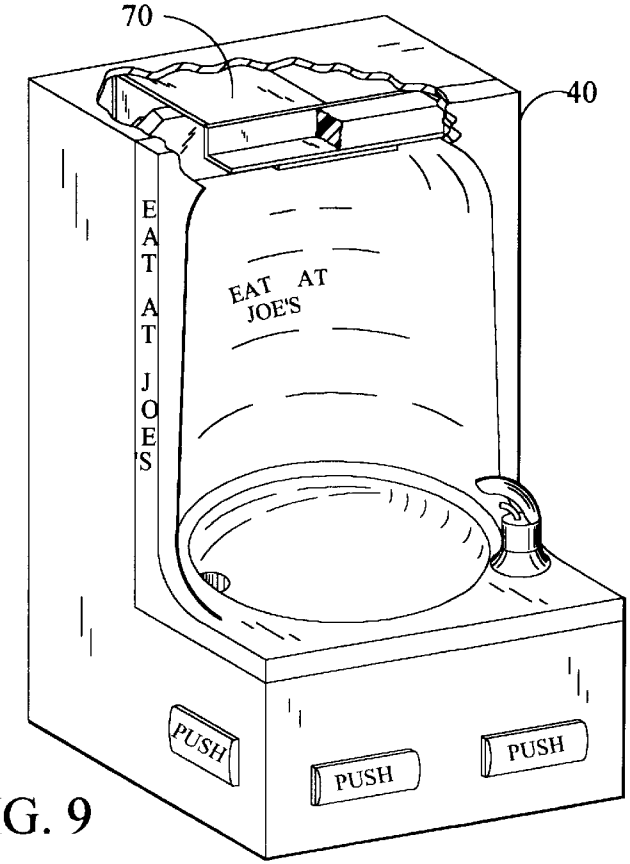
FIG. 9 is a perspective view of another backlighting device for use with an advertising device according to the present invention.
Figure 10:
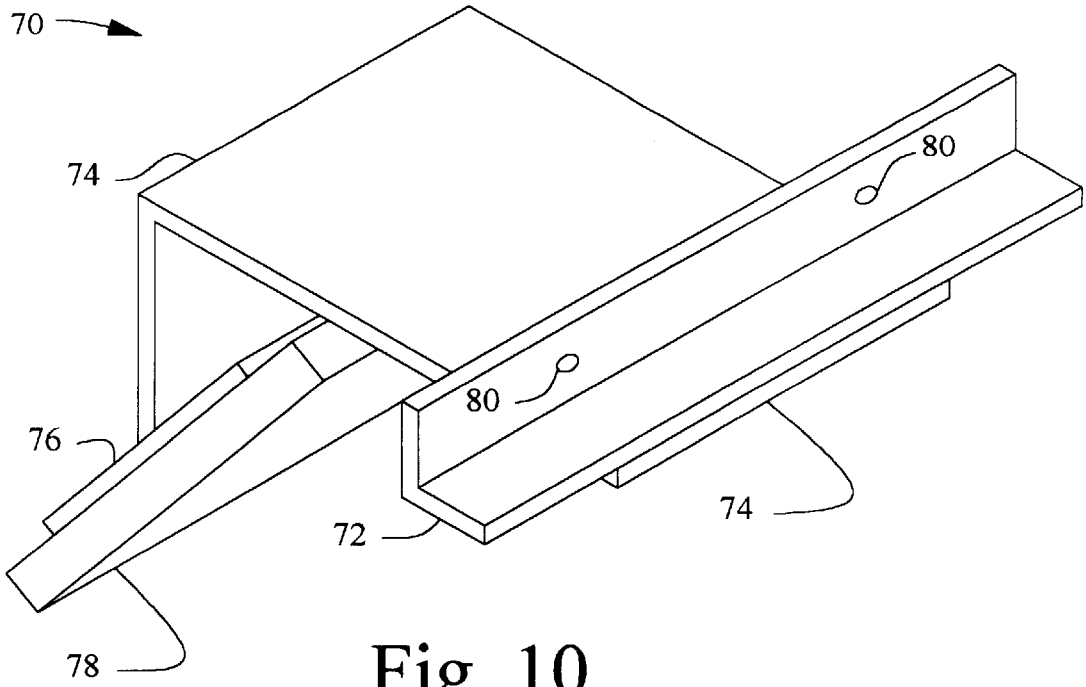
FIG. 10 is a perspective view of the light bracket assembly shown in FIG. 9.
Figure 11:
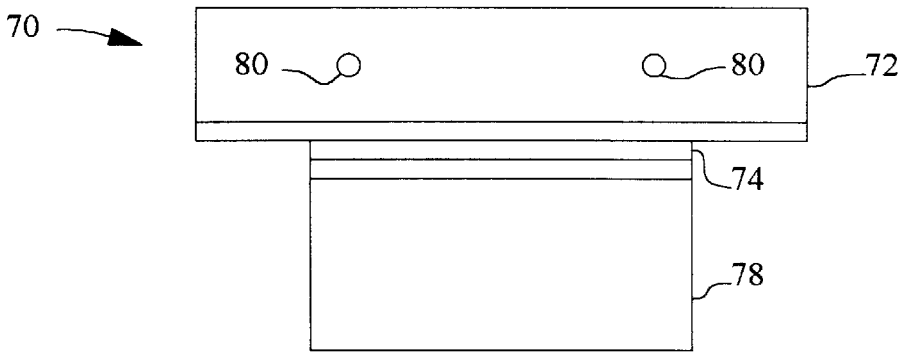
FIG. 11 is a front elevational view of the light bracket assembly of FIG. 10.

Referring now to FIGS. 9, 10 and 11, another lighting bracket assembly 70 for use with the embodiments shown in FIGS. 4 and 5 is shown. Bracket 70 includes angle member 72, angle member 74 and mounting plate 76. Bracket 70, angle member 72, angle member 74 and mounting plate 76 are constructed of metal or plastic. If made from metal, bracket 70, angle member 72, angle member 74 and mounting plate 76 are welded together or attached to one another using fastener techniques well known in the art. Adhesives are used to attach bracket 70, angle members 72 and 74 and mounting plate 76 to one another as shown in FIG. 10 if these components are constructed of plastic materials. A light housing 78 is shown attached to mounting plate 76. Light housing 78 is attached using common fastener techniques such as screws, nuts, bolts, or adhesives. Light housing 78 is a fluorescent lamp lighting fixture including appropriate components for illuminating fluorescent light bulbs (not shown). Bracket assembly 70 is attached to advertising device 40 via bolts, screws, adhesives or the like. Mounting holes 80 receive screws or bolts to securely attach bracket assembly 70 to device 40. As with the light fixture of FIG. 6, power signals are obtained from power wiring within the fountain 12 and supplied to light housing 78.

It is disclosed that device 10 and 40 are made from clear plastic, yet it may be desirable to apply a coating such as paint or the like to certain portions of devices 10 and 40 so as to make those portions opaque, thus obscuring from view certain the internal mechanisms of the drinking fountain 12.

Although two conventional lighting techniques are disclosed, it is contemplated that any of the various known lighting mechanisms, including fiber optics, electroluminescent lighting, light pipes and the like are contemplated as immediate substitutes for the lighting techniques disclosed herein.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An advertising device for use with a drinking fountain having a combination splash guard/basin with a drain aperture in the splash guard/basin, and a water dispensing spout attached to the splash guard/basin, said advertising device comprising:

a thin plastic member shaped to conform with the splash guard/basin of the drinking fountain, said thin plastic member including a water dispensing aperture for receiving the water dispensing spout therethrough and a drain aperture situated to coincide with the drain aperture of the drinking fountain, and wherein said thin plastic member is disposed immediately adjacent and overlaying the splash guard/basin of the drinking fountain; and advertising material attached to said thin plastic member and disposed behind the exposed surface of said thin plastic member.

2. The device of claim 1 wherein said thin plastic member is a plastic laminate having a first laminate layer and a second laminate layer, wherein said advertising material is disposed between said first laminate layer and said second laminate layer, and wherein said first laminate layer is transparent.

3. The device of claim 1 wherein said thin plastic member is constructed from transparent plastic and wherein said advertising media is attached to said thin plastic member and disposed between said thin plastic member and said drinking fountain.

4. The device of claim 2 including a light source means situated between said splash guard/basin and said thin plastic member for producing light behind said advertising media.

5. The device of claim 3 including a light source means situated between said splash guard/basin and said thin plastic member for producing light behind said advertising media.

6. The device of claim of 1 further comprising means for producing backlighting behind said advertising material.

7. The device of claim 3 including means for removably receiving advertising material, said means for removably receiving being attached to said thin plastic member and disposed between said thin plastic member and said splash guard/basin.

8. The device of claim 7 wherein said means for removably receiving advertising material is a long narrow aperture formed in said thin plastic member and sized to coincide with said advertising material.

9. The device of claim 8 including a light source means for producing light behind said advertising media.

10. A drinking fountain comprising:

a housing;

bubbler means for producing a flow of water, said bubbler means attached to a source of pressurized water;

a clear plastic splash guard/basin attached to said housing, said splash guard/basin including a substantially vertical splash guard portion and a substantially horizontal liquid collection basin portion having a depression therein, a bubbler aperture, and a drain aperture disposed in said basin portion, and wherein said bubbler is disposed in said bubbler aperture and attached to said plastic splash guard/basin;

a drain pipe attached over said drain aperture of said plastic splash guard/basin; and advertising material attached to said plastic splash guard/basin, said advertising material disposed between said housing and said plastic splash guard/basin.

11. The device of claim 10 including lighting means disposed within said housing, said lighting means providing a source of light directed toward said advertising material.

12. The device of claim 11 wherein said lighting means is an incandescent bulb.

13. The device of claim 12 wherein said lighting means is a fluorescent lamp.

14. The device of claim 11 wherein said advertising aperture is disposed between said housing and said splash guard/basin.

15. The device of claim 14 wherein said advertising aperture is a long narrow slot that extends into and terminates within said splash guard portion of said splash guard/basin.

16. A drinking fountain that includes an advertising device, said drinking fountain comprising:

a housing;

a splash guard/basin attached to the housing of said drinking fountain, said splash guard/basin including a substantially vertical splash guard portion and a substantially horizontal basin portion, and wherein said basin portion includes a depression for collection of excess water therein, a drain aperture located in said depression, and said basin portion further including a bubbler aperture;

a water bubbler disposed through bubbler aperture and mounted on said basin portion of said splash guard/basin, said water bubbler being attached to a source of pressurized water within said housing, said water bubbler including a water valve that is actuable to enable and disable water flow therethrough;

advertising material attached to said splash guard/basin, said advertising material disposed between said housing and said splash guard/basin; and wherein said splash guard/basin is transparent where said advertising material is attached thereto and viewable by a user of the drinking fountain.

17. The device of claim 16 including light source means disposed within said housing, said light source means producing a light signal directed toward said advertising material.

18. The device of claim 17 wherein said light source means is attached to said splash guard/basin and wherein said splash guard/basin is made from clear plastic.

19. The device of claim 18 including wherein said splash guard/basin includes an advertising aperture integrally formed in said splash guard/basin and sized to removably receive said advertising material.

* * * * *